US005297674A

United States Patent [19]

Birutis et al.

[11] Patent Number: 5,297,674

[45] Date of Patent: Mar. 29, 1994

[54] MOLDED BILL PAYMENT CENTER CONTAINER WITH REMOVABLE TRAYS

[75] Inventors: Andrius S. Birutis, DuPage County; Michael Jaron, Cook County, both of Ill.; W. Robert Worrell, Hennepin County, Minn.

[73] Assignee: Fellowes Manufacturing Company, Itasca, Ill.

[21] Appl. No.: 973,961

[22] Filed: Nov. 4, 1992

[51] Int. Cl.[5] ..... B65D 90/04; B65D 91/00

[52] U.S. Cl. ..... 206/214; 206/232; 220/23.6; 220/23.83; 220/525; 220/528; 220/555

[58] Field of Search ..... 220/23.6, 23.83, 23.86, 220/254, 525, 527, 528, 555; 206/499, 501, 214, 224, 371, 232

[56] References Cited

U.S. PATENT DOCUMENTS

| | | | |
|---|---|---|---|
| D. 158,368 | 5/1950 | Felts et al. . | |
| D. 221,264 | 7/1971 | Brown . | |
| D. 232,129 | 7/1974 | Evans . | |
| D. 246,548 | 11/1977 | Uyeda . | |
| D. 249,590 | 9/1978 | Berkman . | |
| D. 252,354 | 7/1979 | Uyeda . | |
| D. 257,528 | 11/1980 | Cherry . | |
| D. 288,938 | 3/1987 | Klodt . | |
| D. 304,461 | 11/1989 | Foran et al. . | |
| 2,944,694 | 7/1960 | Kinsey | 220/23.83 X |
| 3,606,511 | 9/1971 | Henning et al. . | |
| 3,985,409 | 10/1976 | Kneier . | |
| 4,118,086 | 10/1978 | Kneier . | |
| 4,529,088 | 7/1985 | Quong | 220/23.6 X |
| 4,643,494 | 2/1987 | Marleau . | |
| 4,662,515 | 5/1987 | Newby, Sr. . | |
| 4,775,199 | 10/1988 | Lanius et al. . | |
| 4,807,776 | 2/1989 | Cortopassi | 220/528 X |
| 4,878,592 | 11/1989 | Lee | 220/23.83 |
| 5,011,013 | 4/1991 | Meisner et al. | 206/499 X |
| 5,092,480 | 3/1992 | Waterston | 220/23.83 X |
| 5,111,958 | 5/1992 | Witthoeft | 220/23.83 X |

OTHER PUBLICATIONS

Delta, Inc. of Arkansas, P.O. Box 1846, Jonesboro, Ark.; 2 page brochure; date unknown.

Delta, Inc. of Arkansas, P.O. Box 1846, Jonesboro, Ark.; one page POLY HOPPER brochure; date unknown.

Contico Automotive, Div. of Contico International, Inc., St. Louis, Mo.; 2 page WORKBOX brochure; 1990.

Plano Molding Company, P.O. Box 189, Plano, Illinois; 12 pages 1989 catalog.

Flambeau Products Corporation, 15981 Valplast Rd., Middlefield, Ohio; pages from 1989 catalog.

Contico, St. Louis, Missouri; 14 page 1989 catalog.

MTM Molded Products Company, P.O. Box 14117, Dayton, Ohio; 2 page TOOL GARD brochure, date unknown.

Rubbermaid Incorporated, Wooster, Ohio; 2 page DESIGN-A-SPACE brochure; 1986.

GSC Technology Corporation, Champlain, N.Y.; one page BENCHMASTER brochure; date unknown.

*Primary Examiner*—Paul T. Sewell
*Assistant Examiner*—Jacob K. Ackun, Jr.
*Attorney, Agent, or Firm*—Willian Brinks Hofer Gilson & Lione

[57] ABSTRACT

A bill payment center container is provided with removable trays so that the items desired for paying bills can be located in a single convenient location. A cover with a slot is provided so that when a bill envelope passes through the slot it is received by one of the trays.

11 Claims, 4 Drawing Sheets

MOLDED BILL PAYMENT CENTER CONTAINER WITH REMOVABLE TRAYS

BACKGROUND OF THE INVENTION

The present invention relates to a bill payment center container that stores and organizes the various items a person needs to pay bills. More particularly, the present invention relates to a molded plastic container having removable trays that can be used to store and organize the various items necessary to pay bills.

It is not unusual for people to either pay their bills upon receipt or to store them in one location until a particular time of the month. If they pay their bills upon receipt, they must retrieve their checkbook, write the check, retrieve a stamp and envelope, and file the informational portion of the bill or discard it. If they pay their bills on a particular day of the month, they typically gather all the bills, the checkbook, a calculator, pens, stamps, and envelopes and the various items necessary to pay the bills. The receipts and the informational portion of the bill are then discarded or filed in a box, a cabinet, or the like. Each of these methods are wasteful and time consuming. Accordingly, many people desire a means to help them organize their bills and minimize the time necessary to pay their bills each month.

The present invention solves this particular problem by providing a portable case having removable trays that can store and organize the incoming bills, envelopes, pens, stamps, calculator, and the like, as well as files for the receipts and informational portion of the bills. Accordingly, all the materials necessary for paying bills can be stored in a single container to thereby minimize the time required to pay one's bills.

SUMMARY OF THE INVENTION

The present invention provides a portable bill payment center container comprising a bin with removable trays, including a vertical tray suitable for storing envelopes and a horizontal tray suitable for storing a calculator, pens, stamps, and the like. The vertical tray is located in the lower portion of the bin with the horizontal tray located in the upper portion of the bin. Preferably, the vertical tray has a vertical height that is a substantial portion of the vertical height of the bin so that the vertical height of the horizontal tray is much less than the vertical height of the vertical tray. More preferably, the combined vertical height of the horizontal tray and the vertical tray when placed within the bin is substantially equal to the vertical height of the walls of the bin. Preferably, the bin and the trays are integrally molded from plastic.

The bin comprises a bottom, an open top opposite the bottom, and four walls. The walls extend substantially vertically upward and include a front wall, a rear wall spaced from and substantially parallel to the front wall, a first side wall at a substantially right angle to the front wall, and a second side wall spaced from and substantially parallel to the first side wall. Preferably, each of the walls extend upwardly a substantially equal amount.

In the most preferred embodiment, a cover is provided and is hinged to the rear wall of the bin. The cover is preferably integrally molded from plastic and is provided with a slot so that when an object passes through the slot it will be received by the vertical tray. The cover may also have a handle provided on its upper surface as well as a clasp on its front surface to engage the front wall of the bin to secure the cover in a closed position.

As noted above, the removable trays include a removable vertical tray suitable for receiving and storing envelopes. The vertical tray is positioned in the lower portion of the bin, preferably supported by the bottom of the bin. The tray has four walls extending substantially vertically upward, preferably a substantial portion of the vertical height of the walls of the bin. The walls include a front wall, a rear wall spaced from and substantially parallel to the front wall, a first side wall at a substantially right angle to the front wall, and a second side wall spaced from and substantially parallel to the first side wall.

Preferably, the length of each of the side walls of the vertical tray is only a portion of the length of the side walls of the bin so that the vertical tray may be located adjacent the front wall or the rear wall of the bin. More preferably, the vertical tray is located adjacent the rear wall of the bin. Preferably, the length of front wall and the rear wall is substantially equal to the length of the front and rear walls of the bin.

The vertical tray is preferably vertically partitioned into one or more vertical compartments with one compartment communicating with the slot in the cover. More preferably, the vertical tray is vertically partitioned into two compartments so that one compartment can hold incoming bills and the other compartment can hold unused envelopes. A handle may also be provided on the vertical to tray so that the tray may be easily removed from the bin.

The removable trays also include a removable horizontal tray. Since it is desired to store and organize stamps, pens and the like, the horizontal tray has a vertical height much less than the vertical height of the vertical tray. The horizontal tray is positioned within the upper portion of the bin and is closer to the top than the vertical tray. The horizontal tray may be supported in several different ways. For example, the horizontal tray may rest on the top edges of the walls of the vertical tray. Alternatively, the horizontal tray may have lips extending outwardly from its walls some of which could rest on the top edge of the walls of the bin.

In one embodiment, the horizontal tray has feet with each foot resting on a ledge provided on the inside of the side walls of the bin to support the horizontal tray above the vertical tray. Alternatively, the side walls of the horizontal tray may extend below the bottom of the horizontal tray to rest on the ledge. In a preferred embodiment, at least one rib is provided on the inside of each wall above each ledge to support the horizontal tray. In a more preferred embodiment, the side walls of the horizontal tray rest on at least two vertical ribs provided on the inside of the side walls of the bin so that the horizontal tray is located closer to the top than the vertical tray.

Of course, if both the vertical tray and horizontal tray have substantially the same length and width dimensions as the bin, the horizontal tray will be located directly above the vertical tray. In this case, an opening is provided in the horizontal tray in the area beneath the slot so that when an object passes through the slot it will be received by the vertical tray.

Alternatively, the length of the side walls of the horizontal tray may be only a portion of the length of the side walls of the bin. In this case, the horizontal tray may be located adjacent the rear wall or the front wall of the bin. Where the horizontal tray is located adjacent the rear wall of the bin, an opening in the horizontal tray in the area beneath the slot again must be provided. Preferably, the horizontal tray is located adjacent the front wall.

In another embodiment, the horizontal tray may be L-shaped so that one side wall is longer than the other wide wall. Of course, in this embodiment the shorter side wall is located near the slot.

In a preferred embodiment, a support wall is provided near the top of the bin and extends from the front wall to the rear wall of the bin. By providing this support wall, hanging folders may also be placed in the bin to store items such as receipts, the informational portion of the bills, and the like.

DETAILED DESCRIPTION OF THE INVENTION AND PREFERRED EMBODIMENTS

Figure 1:
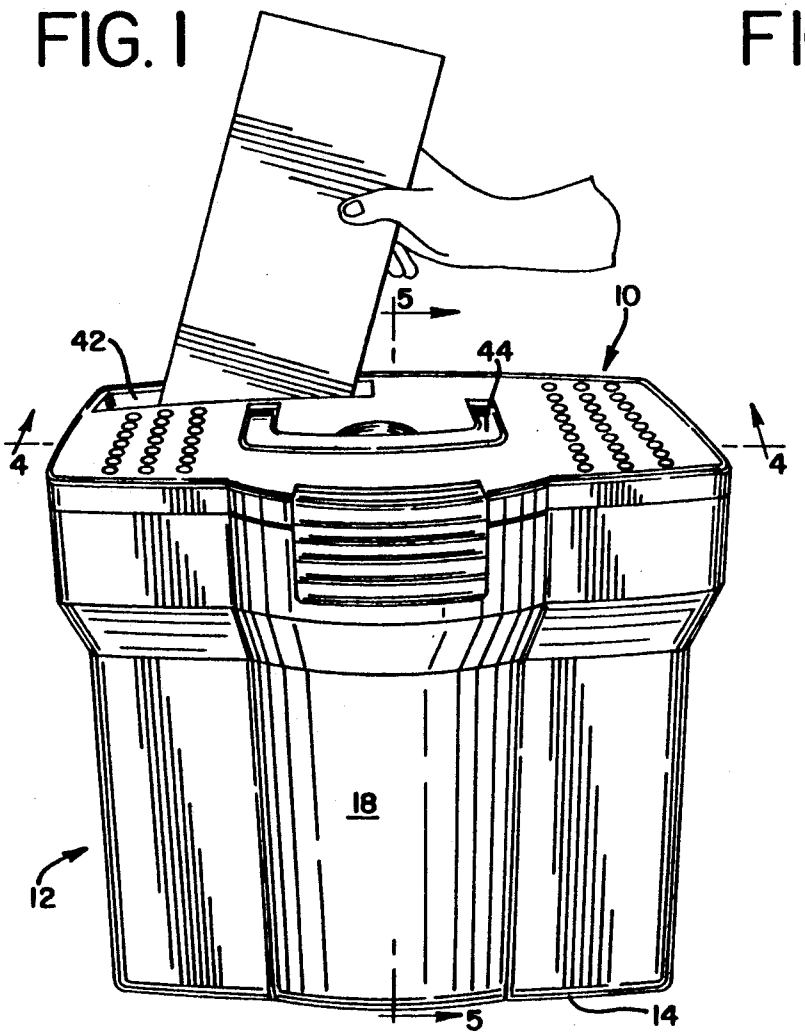
FIG. 1 is a front perspective view of the preferred embodiment of the container of the present invention with a cover in the closed position showing the insertion of an envelope through the slot in the cover.

FIG. 1 illustrates the preferred embodiment of the invention wherein a bill payment center container 10 is shown with an envelope being inserted through a slot 42 provided in the cover 40 of the container. The container 10 consists of a bin 12 having removable trays located therein and, preferably, a cover 40 hinged to the bin 12.

The bin 12 has an open top opposite a bottom 14 and four walls extending substantially vertically upward. The walls include a front wall 18, a rear wall 20 spaced from and substantially parallel to the front wall 18, a first side wall 22 at a substantially right angle to the front wall 18, and a second side wall 24 spaced from and substantially parallel to the first side wall 22, best seen in FIG. 3.

The walls can have any suitable vertical height as is preferred by, among other things, manufacturing and aesthetic considerations. Although it is desirable, each of the walls need not have the same vertical height. For example, the vertical height of the front wall 18 may be less than the vertical height of the rear wall 20. In this case, the side walls would slope from the rear to the front so that the vertical height of the side walls 22 and 24 near the rear wall 20 would be greater than the vertical height near the front wall 18. Preferably, the vertical height of each of the walls is substantially equal and sufficient to contain hanging folders such as manufactured by Pendaflex ® hanging file folders. Most preferably, the walls have a height of about 11 inches.

Figure 4:
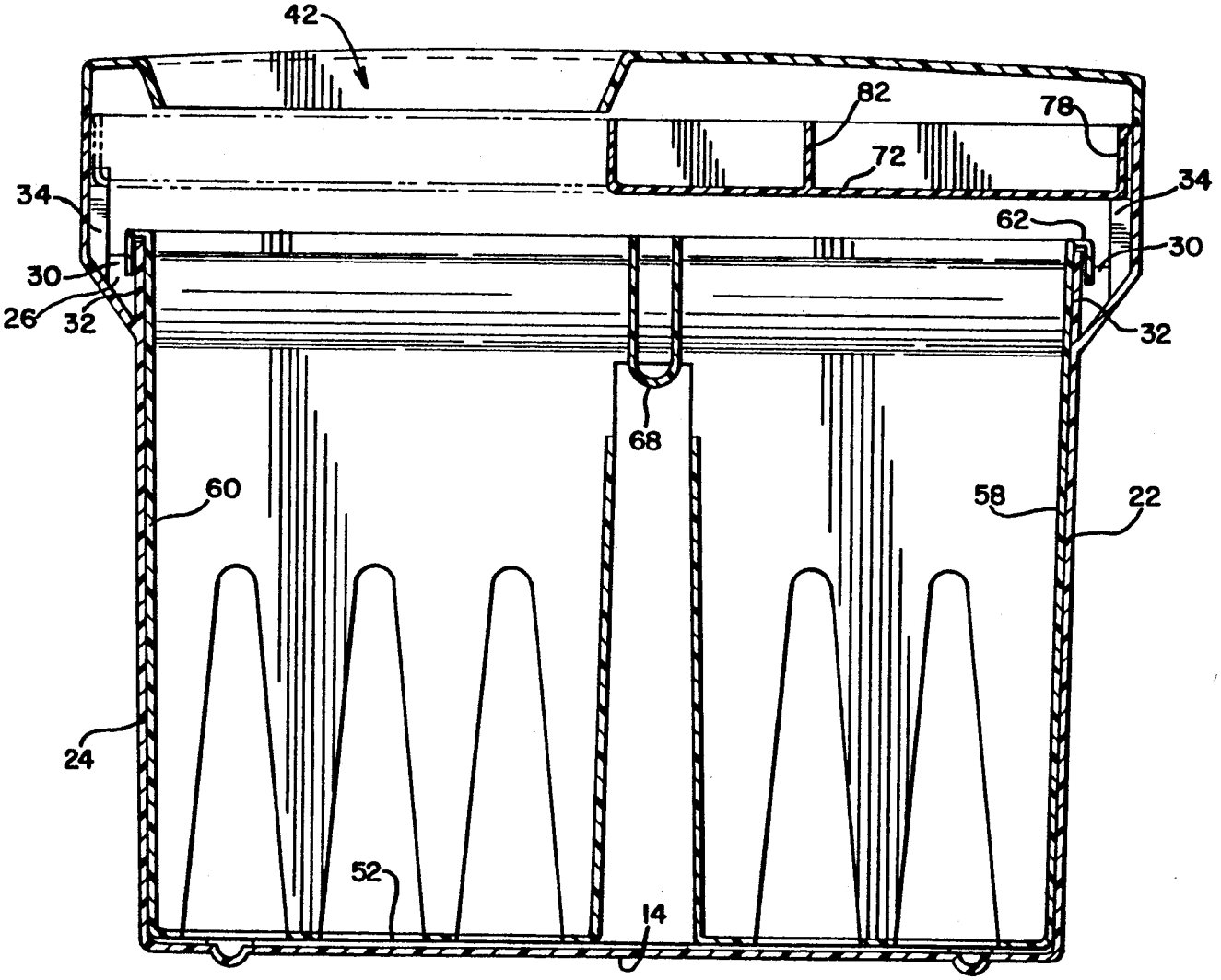
FIG. 4 is a front cross sectional view along line 4—4 of the container of FIG. 1.
Figure 5:
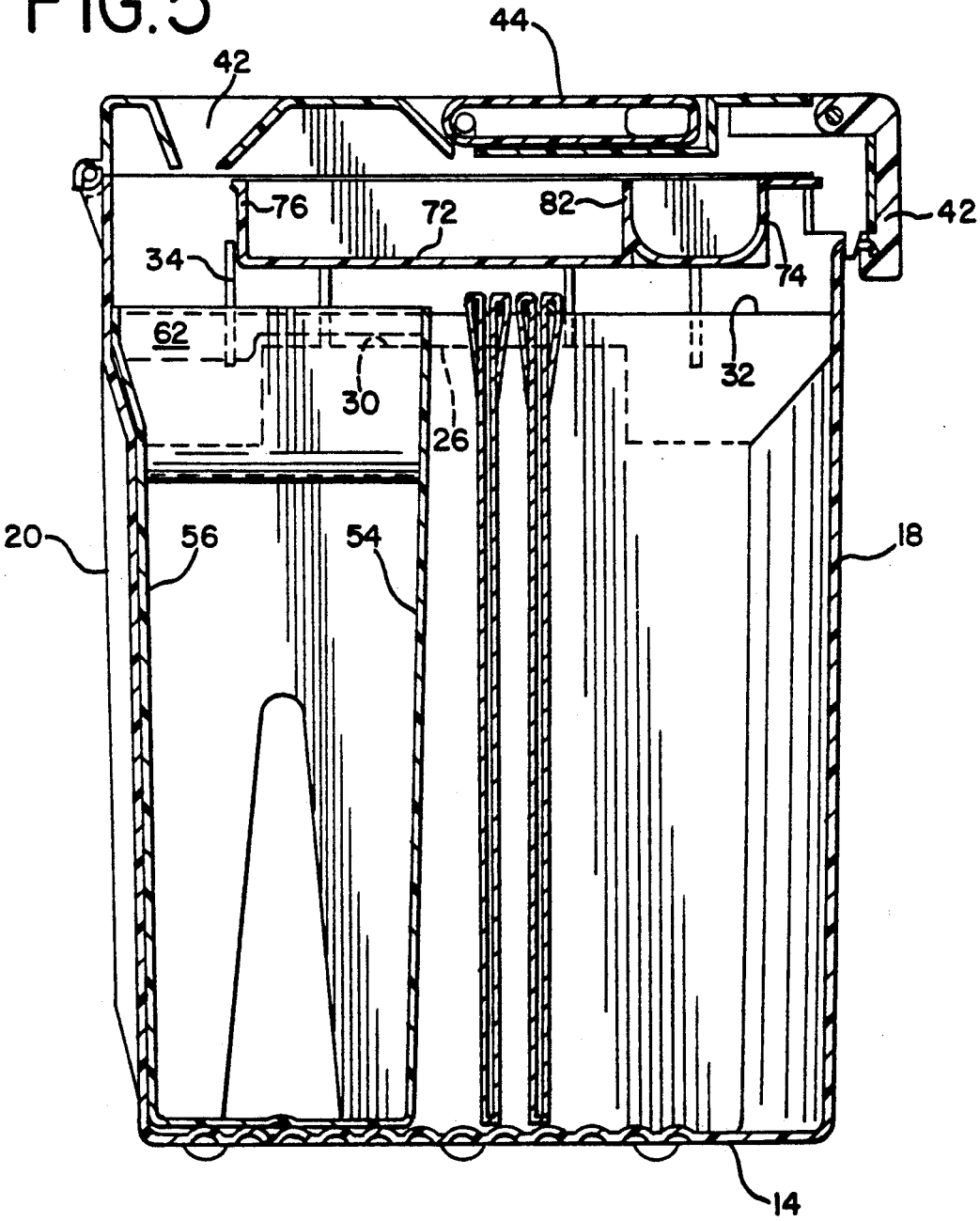
FIG. 5 is a side cross sectional view along line 5—5 of the container of FIG. 1 and shows another embodiment of the horizontal tray.

The upper portion of the side walls 22 and 24, the front wall 18, and the rear wall 20, near the top, are preferably tapered or beveled outward. At the top, however, the walls are substantially vertical so that the area encompassed by the walls at the top is greater than the area encompassed by the walls at the bottom. Where the side walls 22 and 24 are tapered outward, hand grips 26 may be provided on the side walls at about the midpoint between the front wall 18 and the rear wall 20 by, for example, interrupting the beveled surface to provide a horizontal surface as best seen in FIGS. 4 and 5. By providing hand grips 26 in this manner, the bin 12 may be easily lifted. Of course, other means of providing hand grips or handles on the side walls 22 and 24 are contemplated whether or not the side walls are beveled.

As noted above and as best seen in FIG. 2, a cover 40 is preferably hinged to the rear wall 20 of the bin 12. Of course, the cover 40 can be hinged in any manner well known to those skilled in the art. Preferably, the hinge is constructed of two parts with a first part integrally molded of plastic with the cover 40 and a second part integrally molded of plastic with the bin 12.

The cover 40 is provided with a slot 42 preferably tapered downwardly about its periphery. The slot 42 is sized at least as large as an envelope. More preferably, the slot 42 has a width of about 0.5 inches and a length of about 6 inches. It is understood that the slot 42 may be provided at any convenient location on the cover 40. Preferably, the slot 42 is located at the rear of the cover near a side wall, preferably the second side wall 24, so that a handle 44 may be provided in the center region of the cover 40. The handle 44 is preferably recessed within the cover 40 but may be provided in any suitable fashion. The cover 40 may also have a clasp 42 provided at its front surface which can engage the front wall 18 of the bin 12 to secure the cover 40 in a closed position.

A locking means may also be provided on the cover 40 to engage a surface of the front wall 18 of the bin to secure the cover 40 from unauthorized opening. The locking means can be a metal or plastic key lock and other well known means for locking.

Figure 3:
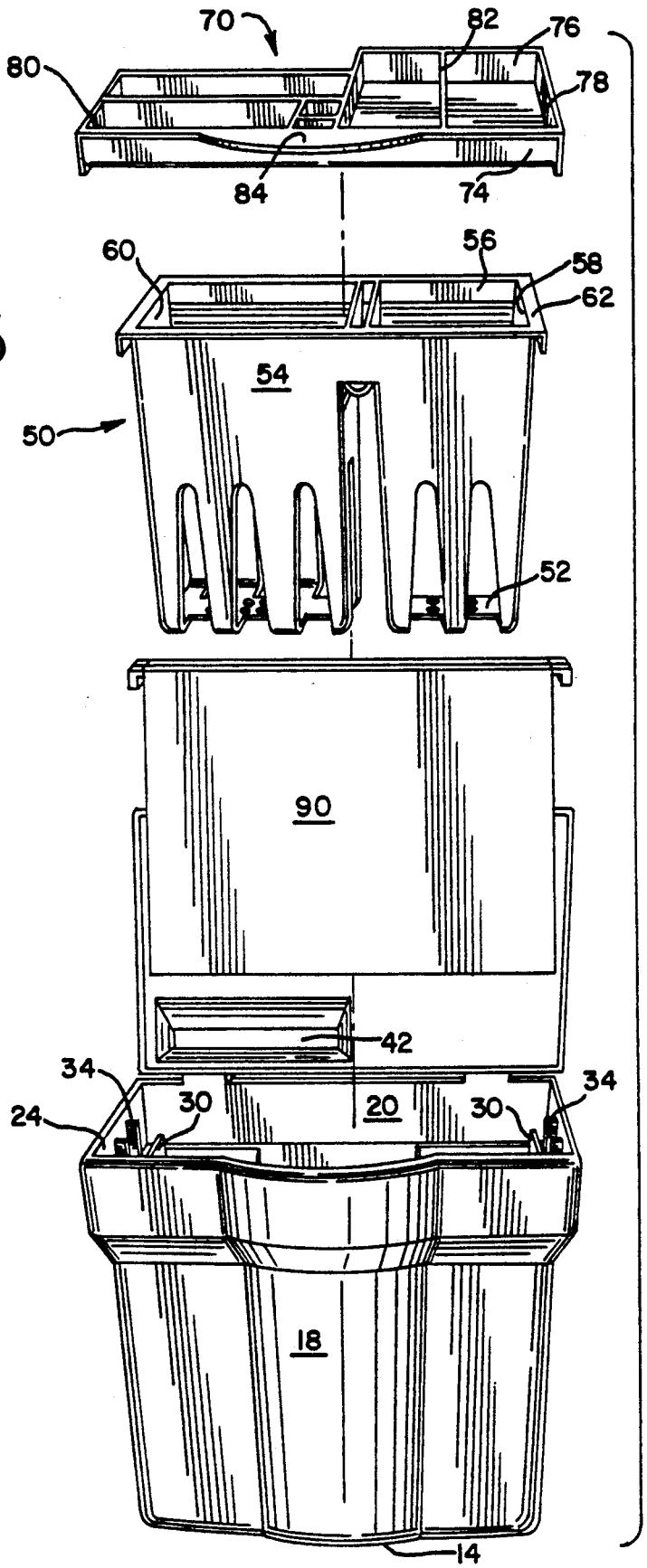
FIG. 3 is an exploded view of the container of FIG. 1 and shows another embodiment of the horizontal tray with the preferred means of supporting the vertical and horizontal trays.

Referring now to FIG. 3, the most preferred embodiment of the bill payment center container 10 is shown in an exploded view and comprises a bin 12, a removable vertical tray 50 and one embodiment of a removable horizontal tray 70 and optionally, a hanging folder 90. Preferably, each of the bin 12, the cover 40, the vertical tray 50, and the horizontal tray 70 are integrally molded of plastic so that the container 10 is portable, lightweight and can be easily and inexpensively manufactured.

The removable vertical tray 50 is provided with a bottom 52, an open top opposite the bottom, and four walls extending substantially vertically upward. The walls include a front wall 54, a rear wall 56 spaced from and substantially parallel to the front wall 54, a first side wall 58 at a substantially right angle to the front wall 54, and a second side wall 60 spaced from and substantially parallel to the first side wall 58. One or more of the walls at their top edge may have a lip extending outward. Preferably, at least the top edge of the first side wall 58 and the second side wall 60 is provided with a lip 62 extending outward, and more preferably, the lip 62 is downturned to more securely position the vertical tray 50. Most preferably, the lip 62 extends downward a greater distance near the rear wall 56 than near the front wall 54, as will become clear later.

The walls of the vertical tray 50 may have any suitable height up to the height of the walls of the bin 12. Although it is desirable, each of the walls need not have the same vertical heights. Preferably, the vertical height of the walls of the vertical tray 50 are a portion of the vertical height of the walls of the bin 12. More preferably, the vertical height of the walls of the vertical tray 50 is sufficient to receive and store envelopes, i.e., at least about 9 inches.

When the vertical tray 50 is placed within the bin 12, its bottom 52 will preferably rest on and be supported by the inside surface of the bottom 14 of the bin 12. Alternatively, the vertical tray may be supported by lips 62 that can rest on the top edges of two or more walls of the bin. For example, where the top edge of the side walls 58 and 60 of the vertical tray is provided with a lip 62, the lips can rest on the top edge of the side walls 22 and 24 of the bin. In a similar manner, lips can be provided on the front and rear walls of the vertical tray 50 to rest on the front and rear walls of the bin 12. Of course, if a lip 62 is provided on the side walls 58 and 60, a ledge, a horizontal rib, one or more vertical ribs, and other like supporting means can be provided on the inside surface of the side walls 22 and 24 to support the vertical tray 50 especially when the vertical height of the tray 50 is only a portion of the vertical height of the walls of the bin 12.

The front wall 54 and rear wall 56 may have any length up to the distance between the inside surface of the first side wall 22 and the second side wall 24 of the bin 12. Preferably, the lengths of the front wall 54 and rear wall 56 are substantially equal and are slightly less than the distance between the side walls 22 and 24 so that the vertical tray 50 may be easily placed within and removed from the bin 12.

The first side wall 58 and second side wall 60 may have any length up to the distance between the inside surface of the front wall 18 and the rear wall 20 of the bin 12. Preferably, the lengths of the first side wall 58 and second side wall 60 are substantially equal and are a portion of the distance between the front wall 18 and the rear wall 20. For example, the length of the side walls 58 and 60 can be about one-half the distance between the front wall 18 and the rear wall 20. In this case, the vertical tray 50 may be located adjacent the front wall 18, adjacent the rear wall 20, or somewhere in between. Generally, the location of the vertical tray 50 is dictated by the location of the slot 42 provided on the cover 40 so that when an envelope passes through the slot 42 it is received by the vertical tray 50. Most preferably, the vertical tray 50 is located adjacent the rear wall 20 with a portion of the tray 50 located beneath the slot 42 provided on the cover 40.

The vertical tray 50 is most desirably vertically partitioned into one or more sections or compartments by, for example, a divider. Preferably, the tray 50 is partitioned into two compartments so that, for example, unused envelopes can be stored in one section while the other section, which will be located beneath the slot 42, can receive the bills to be paid. Alternatively and more preferred, as best seen in FIG. 3, the vertical tray 50 comprises two separate compartments joined at the upper portion of the tray 50.

The vertical tray 50 may be provided with a handle 68 so that the tray 50 can be easily removed from the bin 12. Preferably, the handle 68 extends from the front wall 54 to the rear wall 56.

As noted above, the removable trays include a removable horizontal tray 70 suitable for storing and organizing items useful for paying bills such as stamps, pens, a calculator, and other such items. The removable horizontal tray 70 is provided with a bottom 72 and four walls extending substantially vertically upward. The walls include a front wall 74, a rear wall 76 spaced from and substantially parallel to the front wall 74, a first side wall 78 at a substantially right angle to the front wall 74, and a second side wall 80 spaced from and substantially parallel to the first side wall 78.

One or more of the walls of the horizontal tray 70 may have a lip 84 extending outward at their top edge. Most preferably, the front wall 74 has a lip 84 provided at its top edge so that the tray 70 can be easily removed from the bin 12.

The walls of the horizontal tray 70 may have any suitable height such that when the vertical tray 50 and the horizontal tray 70 are placed within the bin 12, they do not extend beyond the top edges of the walls of the bin more than a slight amount, preferably less than about 1 inch. Of course, when either one of the trays, or both have lips resting on any one of the top edges of the walls of the bin, the trays extend beyond the walls of the bin an amount substantially equal to the thickness of the lips.

Generally, the vertical height of the horizontal tray 70 is substantially less than the vertical height of the vertical tray 50. In this way, the horizontal tray can be placed within the upper portion of the bin 12 and the vertical tray 50 may be placed within the lower portion of the bin. Accordingly, in some instances, the horizontal tray 70 may be located above the vertical tray 50 as will be more fully explained below.

The front wall 74 and rear wall 76 may have any length up to the distance between the inside surface of the first side wall 22 and the second side wall 24 near the top of the bin 12. When the side walls 18 and 20 are beveled, the distance between the side walls 22 and 24 is greater near the top than near the bottom 14. Preferably, the lengths of the front wall 74 and rear wall 76 are substantially equal and are slightly less than the distance between the side walls 22 and 24 near the top of the bin 12 so that the horizontal tray 70 may be easily placed within and removed from the bin 12.

Figure 2:
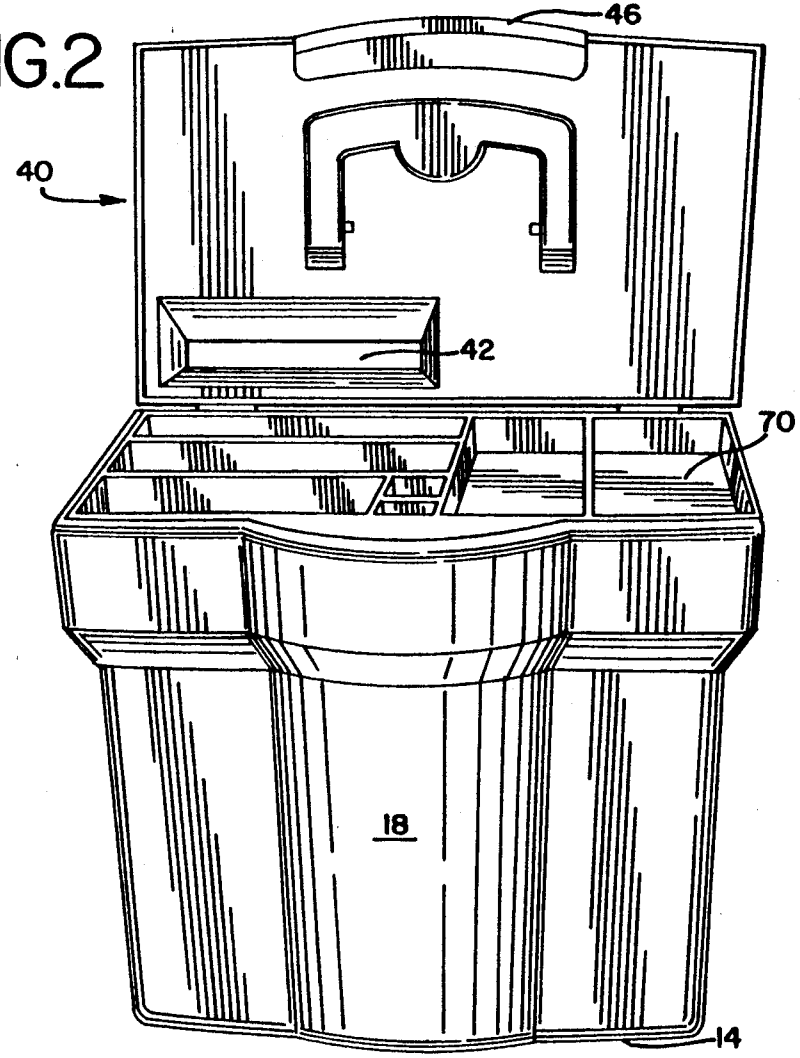
FIG. 2 is a front perspective view of the container of FIG. 1 with the cover in an open position showing one embodiment of the horizontal tray.

The first side wall 78 and second side wall 80 may have any length up to the distance between the inside surface of the front wall 18 and the rear wall 20 near the top of the bin 12. Preferably, the lengths of the first side wall 78 and second side wall 80 are substantially equal and are a portion of the distance between the front wall 18 and the rear wall 20. In this case, the horizontal tray 70 may be located adjacent the front wall 18, adjacent the rear wall 20, or somewhere in between. Most preferably, as seen in FIG. 5, the horizontal tray 70 is located adjacent the front wall 18.

Where the horizontal tray 70 has approximately the same dimensions as the bin 12, as best seen in FIG. 2, the tray 70 is located above the vertical tray 50 and an opening is provided in the bottom 72 in the area beneath the slot 42 so that when an object passes through the slot 42 it will be received by the vertical tray 50. In another embodiment, best seen in FIG. 3, the first side wall 78 is longer than the second side wall 80 so that the horizontal tray 70 is L-shaped. In this embodiment, the shorter side wall 80, is located adjacent the slot 42. Of course, if the slot 42 were in a different location, the tray 70 could be configured so that the shorter side wall is located adjacent the slot.

The horizontal tray 70 is preferably provided with dividers 82 extending upward from the bottom 72 so that the tray 70 may have suitably sized compartments for pens, stamps, and other items desirable for paying bills. The dividers can extend from any of the walls a portion or the entire length from one wall to any opposite wall.

It is to be understood that the present invention provides a bin 12 with a vertical tray 50 placed within the lower portion of the bin 12 and a horizontal tray 70 placed within the upper portion of the bin 12. As previously noted, several different means can be used to support the horizontal tray 70 in the upper portion of the bin 12 with the vertical tray 50 in the lower portion of bin 12.

In the most preferred embodiment, where the side walls 22 and 24 are beveled outward near the top and hand grips 26 are provided, as best seen in FIG. 5, a shelf 30 is provided on the inside of the side walls 22 and 24 due to the formation of the hand grips. As noted above, downturned lips 62 may be provided on the side walls 58 and 60 of the vertical tray 50. The lips 62 near the rear of the tray extend downwardly a greater amount than near the front of the tray 50 (FIG. 5). By providing the shelf 30 and the lips 62 in this manner, the tray 50 is substantially positioned and secured from forward movement when placed within the bin 12. The front portion of the lips 62 that extend downwardly a greater amount will substantially abut the shelf to secure the tray 50 from forward movement when placed within the bin 12.

In this most preferred embodiment, the horizontal tray 70 may be provided with downwardly extending feet that rest on the shelf 30 to position the horizontal tray 70 closer to the top than the vertical tray 50. Alternatively, the side walls 78 and 80 of the horizontal tray 70 may extend downwardly below the bottom 72 to rest on the shelf 30.

In another embodiment, the length of each of the walls of the horizontal tray 70 may closely approximate the length of each of the walls of the vertical tray 50 so that the horizontal tray 70 is supported by the vertical tray. Alternatively, the tray 70 may be supported on the walls of the bin 12 by an outwardly extending lip provided at the top edge of one or more wall 74, 76, 78, 80.

In another embodiment, a horizontal rib or ledge may be provided on each side wall 22 and 24 above the shelf 30 to support the horizontal tray 70 along the lateral edges formed by the side walls 78 and 80 and the bottom 72. Of course, a horizontal rib or ledge may be provided on the front wall 18 and the rear wall 20 to support the horizontal tray along the edges formed by the front 74 and rear 76 walls and the bottom 72.

Where the rib or ledge is provided on a side wall 22 and 24, it will preferably extend outwardly from the side wall 22 and 24 a distance sufficient to provide a stable support surface for the horizontal tray 70. The rib will preferably be located at about the midpoint of the distance between the front wall 18 and the rear wall 20 and may extend a portion or the entire distance toward the front wall 18 and the rear wall 20. Where the horizontal tray 70 has side walls 78 and 80 that are a portion of the side walls 22 and 24, it is desirable to provide a stop on the rib so that when the tray is placed on the rib the stop will substantially abut the rear wall 76 to secure the tray 70 from rearward movement.

Alternatively, more than one rib 34 may be provided on each side wall to support the horizontal tray. Of course the horizontal tray can be supported along its side lateral edges or by lips provided at the top edges of its walls, as previously noted. In this case, the ribs 34 are preferably vertical, extend outwardly from the side walls 22 and 24, and have a suitable thickness to support the horizontal tray 70. As noted above, the horizontal tray may be supported along the lateral edges formed by the side walls and the bottom of the tray or may be supported by outwardly extending lips formed at the top edge of the walls of the horizontal tray. Of course, the ribs 34 may extend downward to the bottom 14 of the bin 12. Most preferably, when the length of the side walls 78 and 80 of the horizontal tray 70 are substantially equal and only a portion of the length of the side walls 22 and 24 and with the tray 70 located adjacent the front wall 18, four vertical ribs 34 are provided on each side wall 22 and 24 so that the tray 70 rests on three of those ribs 34 (see FIG. 5). The fourth rib 34 extends upward a distance greater than the other ribs 34 to substantially abut the rear wall 76 of the tray 70 so that the tray 70 is substantially positioned and secured from rearward movement. Of course, any number of supporting ribs 34 may be provided to support the tray 70.

Referring now to the most preferred embodiment shown in FIG. 4, a support wall 32 is provided coextensive with each side wall 22 and 24 of the bin 12. The support wall 32 extends from the rear wall 20 to the front wall 18 and is located in the area where the side walls are beveled outward. By providing such a support wall 32, hanging folders can be placed within the bin 12 adjacent the front wall 18 to store receipts, the informational portion of bills, and the like.

Of course, a support wall may be provided that is not coextensive with the side walls. In this case, the support wall would extend from the front wall 18 to the rear wall 20 of the bin 12. Alternatively, a shelf may be provided whereby a hanging folder may be supported. It may be desirable to provide an upwardly extending lip at the distal edge of the shelf to more securely support the hanging folder.

Although it is advantageous that the vertical tray be removable so that the user can remove it when paying their bills, it is possible to provide within the bin at least one compartment beneath the slot to receive incoming bills. In this case, where the slot is located adjacent the rear wall, one or more vertical walls extending upwardly from the bottom of the bin can be provided to receive incoming bills and to store unused envelopes.

It should be understood that a wide range of changes and modifications can be made to the embodiments described above. It is therefore intended that the foregoing description illustrates rather than limits this invention, and that it is the following claims, including all equivalents, which define this invention.

We claim:

1. A molded plastic portable bill payment center container comprising:

a. a bin with a bottom, an open top opposite the bottom, and four walls extending substantially vertically upward and including a front wall, a rear wall spaced from and substantially parallel to the front wall, a first side wall at a substantially right angle to the front wall, and a second side wall spaced from and substantially parallel to the first side wall;

b. a cover having a rear hinged to the rear wall of the bin, the cover further having a slot therein to receive an object through it and into the bin;

c. a removable vertical tray supported by the bottom of the bin, the tray having four tray walls extending substantially vertically upward. the walls including a front wall, a rear wall spaced from and substantially parallel to the front wall, a first side wall at a substantially right angle to the front wall, and a second side wall spaced from and substantially parallel to the first side wall, and when the vertical tray is disposed within the bin, the tray walls extend upward a substantial portion of the vertical height of the bin walls and a portion of the tray is located beneath the slot so that the object passing through the slot is received by the tray; and, d. a removable horizontal tray having four tray walls extending substantially vertically upward, the horizontal tray walls including a front wall, a rear wall spaced from and substantially parallel to the front wall, a first side wall at a substantially right angle to the front wall, and a second side wall spaced from and substantially parallel to the first side wall, the walls of the horizontal tray having a vertical height less than the vertical height of the walls of the vertical tray wherein when the vertical tray and the horizontal tray are disposed within the bin, the horizontal tray is located above the vertical tray and wherein the combined vertical height of the walls of the vertical tray and horizontal tray is substantially the same as the vertical height of the walls of the bin.

2. The bill payment center container of claim 1 wherein the slot is located adjacent the rear of the cover.

3. The bill payment center container of claim 2 wherein the length of the side walls of the vertical tray are a portion of the length of the side walls of the bin.

4. The bill payment center container of claim 3 wherein the rear wall of the vertical tray is located adjacent the rear wall of the bin.

5. The bill payment center container of claim 4 wherein the vertical tray further has two vertical compartments.

6. The bill payment center container of claim 5 wherein the vertical tray further has a handle provided between the front wall and the rear wall.

7. The bill payment center container of claim 1 wherein the length of the walls of the horizontal tray are substantially the same as the length of the walls of the bin near the top of the bin and the horizontal tray is further provided with an opening in the area located beneath the slot when the horizontal tray is disposed within the bin.

8. The bill payment center container of claim 1 wherein the length of the side walls of the horizontal tray are a portion of the length of the side walls of the bin.

9. The bill payment center container of claim 8 wherein the front wall of the horizontal tray is located adjacent the front wall of the bin.

10. A molded plastic portable bill payment center container comprising:

a. a bin with a bottom, an open top opposite the bottom, and four walls extending substantially vertically upward and including a front wall, a rear wall spaced from and substantially parallel to the front wall, a first side wall at a substantially right angle to the front wall, and a second side wall spaced from and substantially parallel to the first side wall, a portion of the side walls near the top being beveled outward;

b. a hand grip provided on the side walls by horizontally interrupting the bevel in the area at about the midpoint between the front wall and the rear wall to provide a shelf within the bin;

c. a cover having a rear hinged to the rear wall of the bin, the cover further having a slot therein located adjacent the rear of the cover to receive an object through it and into the bin;

d. a removable vertical tray supported by the bottom of the bin, the tray having four tray walls extending substantially vertically upward, the walls including a front wall, a rear wall spaced from and substantially parallel to the front wall, a first side wall at a substantially right angle to the front wall, and a second side wall spaced from and substantially parallel to the first side wall, and when the vertical tray is disposed within the bin, the tray walls extend upward a substantial portion of the vertical height of the bin walls and a portion of the tray is located beneath the slot so that the object passing through the slot is received by the tray, the top edge of the side walls further having lips extending outwardly and downwardly with the portion of the lip near the rear wall of the tray extending downwardly a distance greater than near the front wall of the tray such that the forward portion of the lip near the rear wall substantially abuts the shelf to secure the tray from forward movement;

e. at least one vertical rib provided on each side wall of the bin located above the vertical tray; and, f. a removable horizontal tray having four tray walls extending substantially vertically upward, the horizontal tray walls including a front wall, a rear wall spaced from and substantially parallel to the front wall, a first side wall at a substantially right angle to the front wall, and a second side wall spaced from and substantially parallel to the first side wall, the walls of the horizontal tray having a vertical height less than the vertical height of the walls of the vertical tray wherein when the vertical tray and the horizontal tray are disposed within the bin, the horizontal tray is located above the vertical tray and wherein the combined vertical height of the walls of the vertical tray and horizontal tray is substantially the same as the vertical height of the walls of the bin.

11. The molded plastic portable bill payment center container of claim 10 further having a support wall coextensive with the inside surface of each of the side walls of the bin such that the support wall can support one or more hanging folders.

* * * * *